US008944558B2

(12) United States Patent
Kudo et al.

(10) Patent No.: US 8,944,558 B2
(45) Date of Patent: Feb. 3, 2015

(54) LIQUID EJECTION HEAD AND LIQUID EJECTION APPARATUS

(75) Inventors: Kiyomitsu Kudo, Machida (JP); Tomotsugu Kuroda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 327 days.

(21) Appl. No.: 13/216,711

(22) Filed: Aug. 24, 2011

(65) Prior Publication Data

US 2012/0050385 A1 Mar. 1, 2012

(30) Foreign Application Priority Data

Aug. 27, 2010 (JP) ..... 2010-191325

(51) Int. Cl.
*B41J 2/015* (2006.01)
*B41J 2/14* (2006.01)

(52) U.S. Cl.
CPC ..... *B41J 2/14024* (2013.01); *B41J 2202/19* (2013.01)
USPC ..... 347/20

(58) Field of Classification Search
None
See application file for complete search history.

(56) References Cited

FOREIGN PATENT DOCUMENTS

JP 2010-046853 A 3/2010

OTHER PUBLICATIONS

Translation of JP 2010-046853 A. (JP 2010-046853 A was published on Mar. 4, 2010.).*

* cited by examiner

*Primary Examiner* — Justin Seo
(74) *Attorney, Agent, or Firm* — Canon U.S.A., Inc. IP Division

(57) ABSTRACT

A liquid ejection head includes a liquid ejection substrate having an ejection port surface, a support substrate for supporting the liquid ejection substrate, having two first positioning portions being in contact with an attaching portion, to which the liquid ejection head is attached, to determine the position of the liquid ejection head with respect to the attaching portion in a predetermined direction, and a housing for supporting the support substrate, having a second positioning portion being in contact with the attaching portion to determine the position of the liquid ejection head with respect to the attaching portion in the predetermined direction. A surface perpendicular to the ejection port surface and extending along the predetermined direction, having the second positioning portion, is disposed between two surfaces perpendicular to the ejection port surface and extending along the predetermined direction, each having one of the first positioning portions.

9 Claims, 13 Drawing Sheets

LIQUID EJECTION HEAD AND LIQUID EJECTION APPARATUS

BACKGROUND OF THE INVENTION

1. Field of the Invention

The present invention relates to liquid ejection heads for ejecting liquid and to liquid ejection apparatuses.

2. Description of the Related Art

An ink jet recording head, which is a typical liquid ejection head, is positioned with respect to a guide shaft of an ink jet recording apparatus, which is a liquid ejection apparatus, via a carriage (an attaching portion). The ink jet recording head attached to the carriage is scanned along the guide shaft and ejects ink onto a recording medium, such as paper, to form an image.

At this time, the ink jet recording head ejects ink based on an assumption that the direction in which the ejection ports, through which ink is ejected, are arrayed is exactly perpendicular to the scanning direction of the ink jet recording head. However, if the ink jet recording head or the carriage has variation derived from the manufacturing process, the direction of the ejection port array may be inclined, not perpendicular, to the scanning direction. If the direction of the ejection port array is inclined, liquid fails to land on the target position of the recording medium, which may degrade the image quality.

Accordingly, the ink jet recording head needs to be precisely positioned with respect to the carriage such that the direction of the ejection port array is exactly perpendicular to the scanning direction of the ink jet recording head.

Japanese Patent Laid-Open No. 2010-46853 discloses a structure for positioning an ink jet recording head with respect to a carriage.

FIGS. 6A to 6F are diagrams of a carriage B102 of a main body of an ink jet recording apparatus and an ink jet recording head B1 attached thereto. FIGS. 6G and 6H are diagrams of the carriage B102.

As shown in FIGS. 6A and 6B, the ink jet recording head B1 is attached to the carriage B102, which is scanned along a guide shaft B101 of the main body of the ink jet recording apparatus.

When the ink jet recording head B1 is attached to the carriage B102, the ink jet recording head B1 is subjected to a reaction force A acting in a direction indicated by the arrow (FIG. 6E), which is exerted by plate springs B111 (FIG. 6C) that follow a head set lever provided on the carriage B102. The ink jet recording head B1 is also subjected to a reaction force B acting in a direction indicated by the arrow (FIG. 6F), which is exerted by electric connectors B112 (FIG. 6D) that electrically connect the ink jet recording head B1 and the main body of the ink jet recording apparatus. With these reaction forces A and B, the ink jet recording head B1 is positioned with respect to the carriage B102. By abutting a positioning portion on the ink jet recording head B1 to a positioning portion on the carriage B102 utilizing the reaction forces A and B, positioning of the ink jet recording head B1 in the direction Y, i.e., a conveying direction of a recording medium (FIG. 6B), is achieved, and the ink jet recording head B1 is fixed. More specifically, positioning portions B50*a*, B50*b*, and B50*d*, on the ink jet recording head B1 (FIG. 6F) are abutted to positioning portions B120*a*, B120*b*, and B120*d* (FIGS. 6G and 6H) on the carriage B102, respectively. The positioning portions B50*a* and B50*b* on the ink jet recording head B1 are provided on a support substrate B12, the positioning portions B50*d* and B50*e* are provided on an ink supply member B21 (housing).

Herein, the positioning portions B50*a* and B50*b* provided on the support substrate B12 of the ink jet recording head B1 and used for the positioning in the direction Y also serve as reference surfaces when the support substrate B12 and the recording element substrate B11 (liquid ejection substrate) are bonded. As in this case, by making the positioning portions of the ink jet recording head B1 and carriage B102 also serve as the reference surfaces when the support substrate B12 and the recording element substrate B11 are bonded, the recording element substrate B11 can be precisely positioned with respect to the carriage B102.

However, as shown in FIG. 7E, in the ink jet recording head B1, the support substrate B12 may be fixed to the ink supply member B21 with an inclination in the direction indicated by the arrow.

In this case, two positioning portions (B50*d* and B50*e*) on the ink supply member B21 are abutted to the positioning portions on the carriage B102 by the reaction force A. However, although one of the positioning portions provided on the support substrate B12, namely, B50*a*, is abutted to the positioning portion on the carriage B102 by the reaction force B, the other positioning portion, namely, B50*b*, may not be abutted to the positioning portion on the carriage B102. This may degrade the positioning accuracy of the ink jet recording head B1 with respect to the carriage B102 in the direction Y, leading to a decrease in image quality.

SUMMARY OF THE INVENTION

The present invention can improve the positioning accuracy and prevent a decrease in image quality, in a liquid ejection head having a support substrate for supporting a liquid ejection substrate and a housing for supporting the support substrate, each of which having a positioning portion for achieving positioning with respect to an attaching portion in a predetermined direction.

According to an aspect of the present invention, a liquid ejection head for ejecting liquid includes: a liquid ejection substrate having an ejection port surface in which ejection ports for ejecting liquid are provided; a support substrate for supporting the liquid ejection substrate, the support substrate having two first positioning portions being in contact with an attaching portion, to which the liquid ejection head is attached, to determine the position of the liquid ejection head with respect to the attaching portion in a predetermined direction; and a housing for supporting the support substrate, the housing having a second positioning portion being in contact with the attaching portion to determine the position of the liquid ejection head with respect to the attaching portion in the predetermined direction. A surface perpendicular to the ejection port surface and extending along the predetermined direction, the surface having the second positioning portion, is disposed between two surfaces perpendicular to the ejection port surface and extending along the predetermined direction, each surface having one of the two first positioning portions.

The present invention can improve the positioning accuracy and prevent a decrease in image quality, in a liquid ejection head having a support substrate for supporting a liquid ejection substrate and a housing for supporting the support substrate, each of which having a positioning portion for achieving positioning with respect to an attaching portion in a predetermined direction.

Further features of the present invention will become apparent from the following description of exemplary embodiments with reference to the attached drawings.

DESCRIPTION OF THE EMBODIMENTS

Figure 1A:
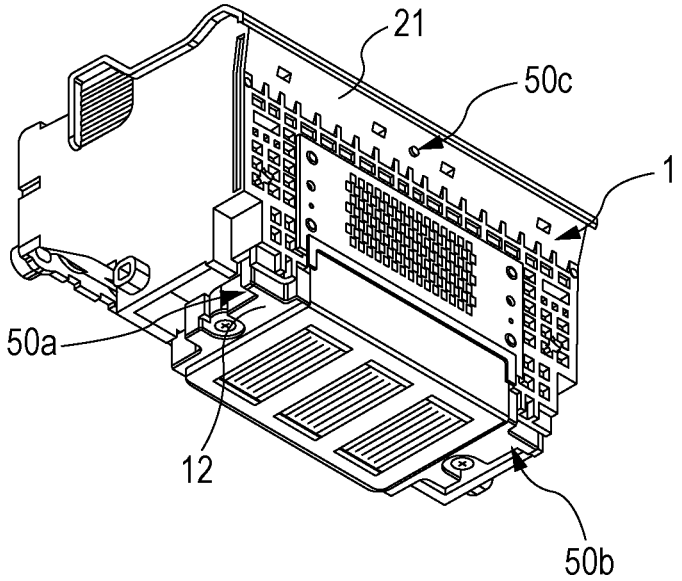
FIGS. 1A and 1B are perspective views of an ink jet recording head according to an embodiment of the disclosure.

Referring to the drawings, embodiments of the present invention will be described in detail below.

Figure 1B:
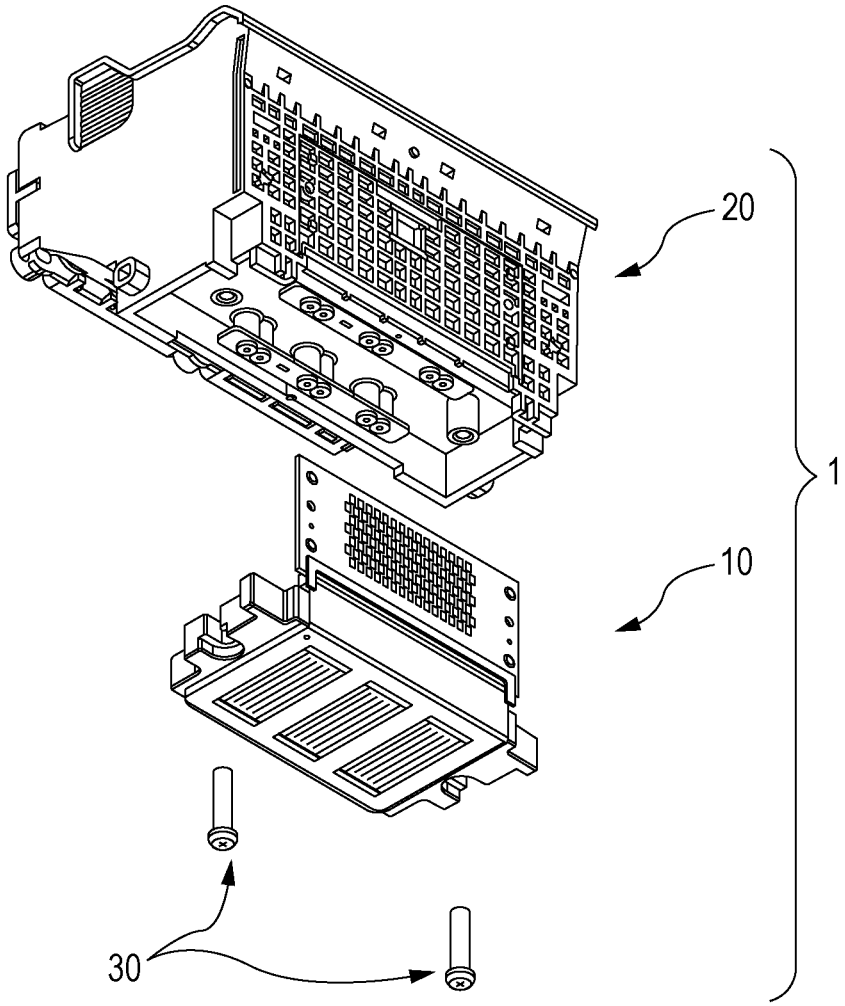
Figure 2:
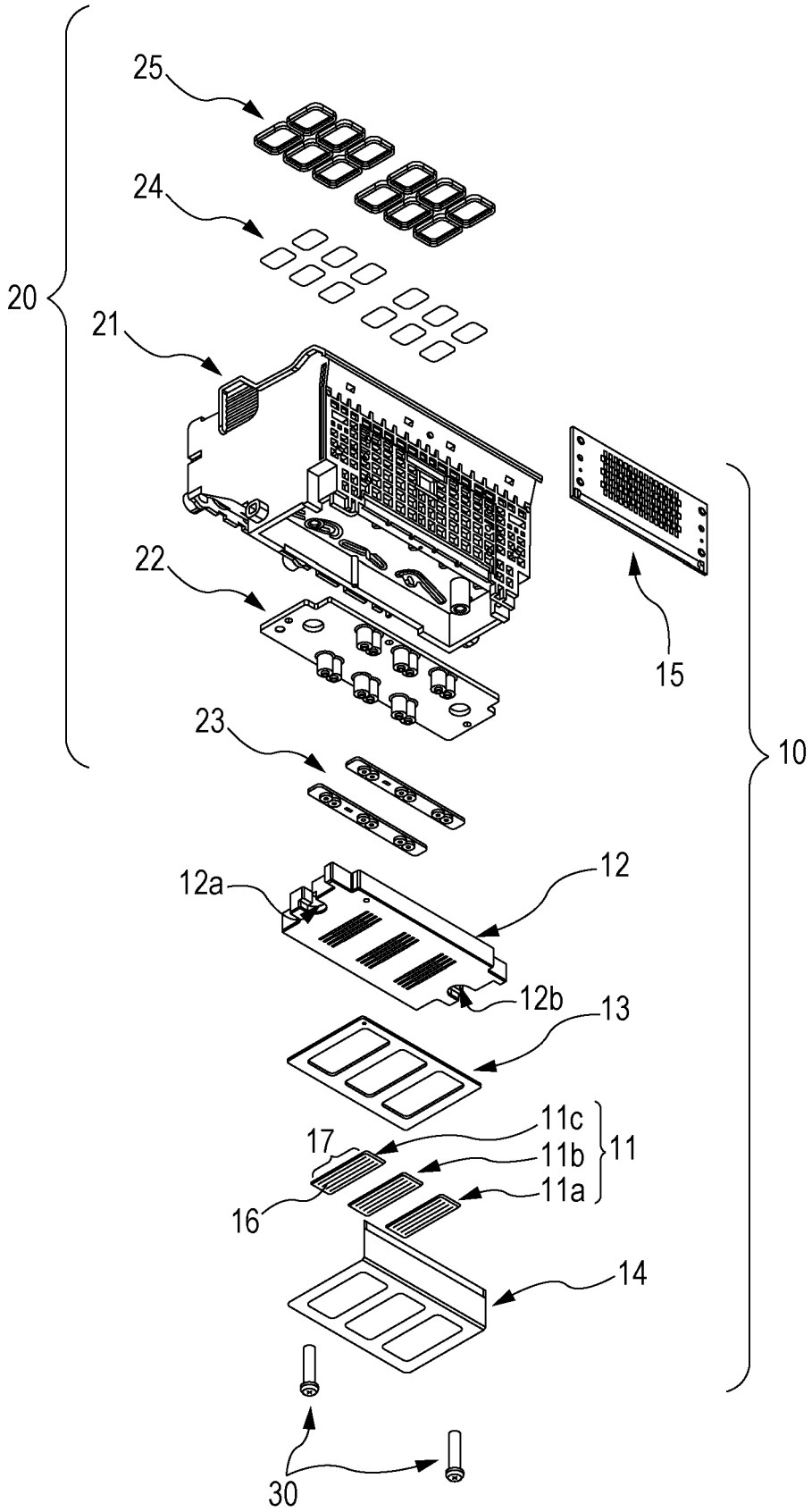
FIG. 2 is an exploded perspective view of the ink jet recording head according to the embodiment of FIGS. 1A and 1B.

FIGS. 1A, 1B and 2 are diagrams of an ink jet recording head 1 to which a liquid ejection head of the present disclosure can be applied. As shown in FIG. 1B, the ink jet recording head 1 includes a recording element unit 10 and an ink supply unit 20.

As shown in FIG. 2, the recording element unit 10 includes three recording element substrates 11 (11*a* to 11*c*) serving as liquid ejection substrates, a support substrate 12, an electric wiring tape 14, an electric contact substrate 15 (electric wiring substrate), and an auxiliary substrate 13. The ink supply unit 20 includes an ink supply member 21 serving as a housing, a flow-path forming member 22, joint seals 23, filters 24, and filter-sealing rubber members 25.

The support substrate 12 for supporting the recording element substrates 11 is made of an alumina (Al2O3) plate having a thickness of about 8 mm. The support substrate 12 has ink supply ports through which four kinds of ink are supplied to the three recording element substrates 11 (11*a* to 11*c*). The support substrate 12 may have screw fixing portions 12*a* and 12*b* at both ends so that it can be connected to the ink supply unit 20.

The recording element substrates 11 are silicon (Si) substrates having a thickness of about 0.625 mm, each having four rows of ink supply ports serving as ink flow paths, which are long groove-like penetrating openings. In some embodiments, the recording element substrates may have fewer or more than four rows of ink supply ports. A row of electrothermal transducers and an electric wiring line made of, for example, aluminum (Al) for supplying power to the electrothermal transducers and may be disposed on each side of each ink supply port. These electrothermal transducers and electric wiring lines may be formed by using deposition.

The electrothermal transducers are arranged in a staggered manner, i.e., are disposed so as to be slightly shifted from one another, such that ejection ports 16 of one row are not aligned with those in the adjacent row in a direction perpendicular to the direction in which the ejection ports 16 are arranged. Furthermore, electrode portions for supplying power to the electric wiring lines are formed along the outer side edges of the electrothermal transducers, and bumps composed of, for example, gold (Au) and are formed on the electrode portions.

On the surface of each Si substrate on which the above-described components are formed, a structure which is made of resin and has an ink-flow-path wall that defines ink flow paths corresponding to the electrothermal transducers and a ceiling that covers the top of the ink-flow-path wall and has the ejection ports 16 is formed by using photolithography. The ejection ports 16 are provided in the ejection port surface of the recording element substrates 11 so as to face the electrothermal transducers, thereby forming ejection port arrays 17. Ink supplied from the ink flow paths is ejected from the ejection ports 16 facing the electrothermal transducers by the pressure of the bubbles generated by the heated electrothermal transducers.

The recording element substrates 11 are precisely bonded to the support substrate 12 such that the ink supply ports in the recording element substrates 11 communicate with the ink supply ports in the support substrate. A first adhesive used in this bonding desirably has low viscosity, is cured at a low temperature for a short time, has relatively high hardness after being cured, and has ink resistance properties. In this embodiment, a heat-curable adhesive mainly composed of epoxy resin is used as the first adhesive, and the thickness of the bonding layer is set to about 5 μm.

The auxiliary substrate 13 is a plate-like member having a thickness of about 0.6 mm and is made of alumina (Al2O3). The auxiliary substrate 13 has three openings sized to be larger than the outer dimensions of the recording element substrates 11 adhered to the support substrate 12. The auxiliary substrate 13 is bonded to the support substrate 12 using a second adhesive. Thus, when the electric wiring tape 14 is attached, the electric wiring tape 14 and the recording element substrates 11 come into contact with and are electrically connected to each other on the same plane.

The electric wiring tape 14 forms an electric signal path for applying electric signals for ink ejection to the recording element substrates 11. The electric wiring tape 14 has three openings corresponding to the recording element substrates 11. Electrode terminals to be connected to electrode portions of the recording element substrates 11 are formed near the edges of these openings. The electric wiring tape 14 has an electric-terminal connecting portion at an end via which it is electrically connected to the electric contact substrate 15 having an external signal input terminal for receiving an electric signal. The electrode terminals and the electric-terminal connecting portion are connected by a continuous wiring pattern made of copper foil. The back surface of the electric wiring tape 14 is securely bonded to the lower surface of the auxiliary substrate 13 with a third adhesive, and the electric wiring tape 14 is bent toward and is securely bonded to a side surface of the support substrate 12. In this embodiment, a heat-curable adhesive mainly composed of epoxy resin is used as the third adhesive, and the thickness of the bonding layer is set to about 20 μm.

Electrical connection between the electric wiring tape 14 and the recording element substrates 11 is established by, for example, bonding the electrode portions of the recording element substrates 11 and the electrode terminals of the electric wiring tape 14 by using thermosonic bonding. The electrically connected portions between the recording element substrates 11 and the electric wiring tape 14 are sealed by a first sealing material and a second sealing material, whereby the electrically connected portions are protected from corrosion due to ink or an externally applied impact. The first sealing material mainly seals the connected portions between the electrode terminals of the electric wiring tape 14 and the electrode portions of the recording element substrates 11 from the back, as well as the outer peripheral portions of the recording element substrates 11, and the second sealing material seals the connected portions from the front.

The electric contact substrate 15 is electrically connected to an end of the electric wiring tape 14 by heat press bonding with an anisotropic conductive film. The electric contact substrate 15 has terminal positioning holes for positioning and terminal fixing holes for fixing.

As shown in FIG. 2, the ink supply member 21 is a component of the ink supply unit 20 for guiding ink to the recording element unit 10. The ink supply member 21 is formed by molding resin. The ink supply member 21 has joint portions that are brought into contact with ink supply ports of a sub-tank unit (not shown) for storing a small amount of ink. Filters 24 for blocking dust from outside are welded thereto, and filter-sealing rubber members 25 for sealing the sub-tank unit and the ink supply member 21 are attached thereto. To prevent the filter-sealing rubber members 25 from leaning in the peripheral direction, the ink supply member 21 has leaning preventing walls around the filter-sealing rubber members 25.

The flow-path forming member 22 having ink introducing ports through which ink is supplied to the recording element unit 10 is positioned such that the ink introducing ports communicate with the ink flow paths of the ink supply member 21 and is attached to the bottom surface of the ink supply member 21 by using ultrasonic welding.

The recording element unit 10 and the ink supply unit 20 are securely welded together with two joint seals 23 having holes at positions corresponding to the ink supply ports in the support substrate 12 and the ink introducing ports in the flow-path forming member 22 therebetween and are fastened with two screws 30.

The joint seals 23 are made of rubber that is less susceptible to compression set. By pressing the recording element unit 10 and the ink supply unit 20 against each other with the joint seals 23 therebetween, the possibility of ink leakage occurring at portions where the ink supply ports and the ink introducing ports communicate with each other can be reduced.

Figure 3A:
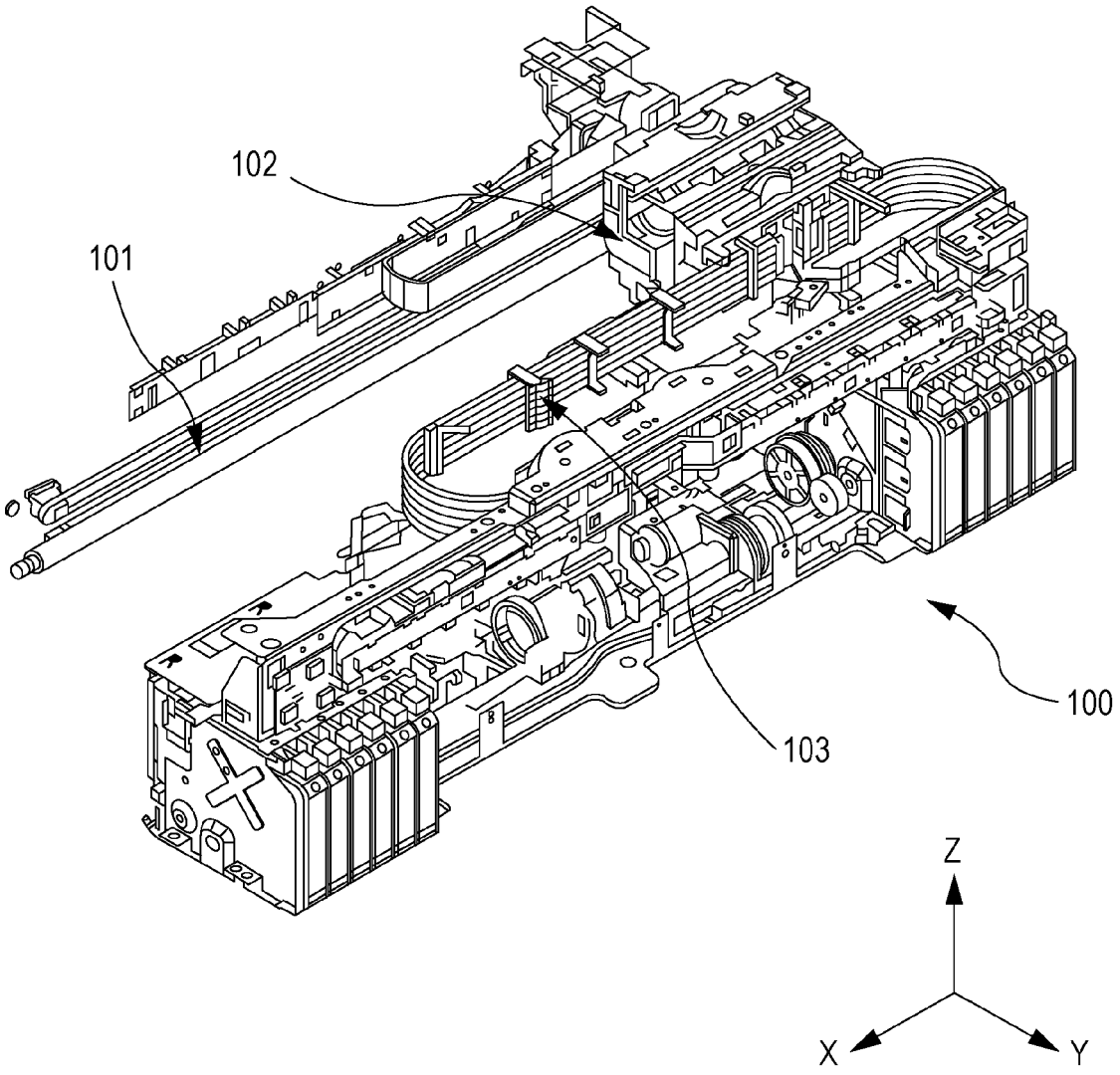
FIGS. 3A to 3D are perspective views of the ink jet recording head attached to the carriage, according to the embodiment of FIGS. 1A and 1B.
Figure 3B:
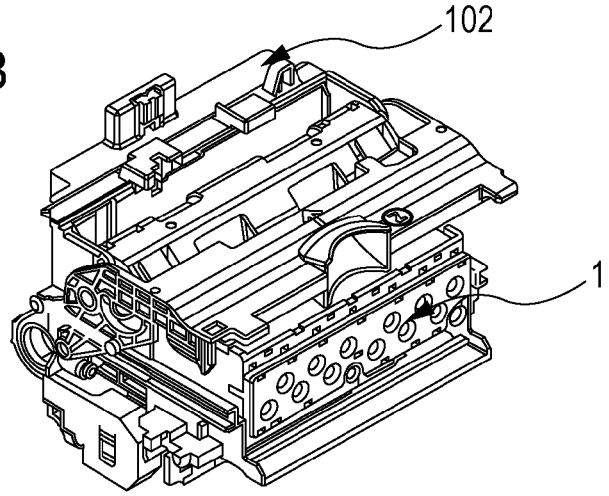
Figure 3C:
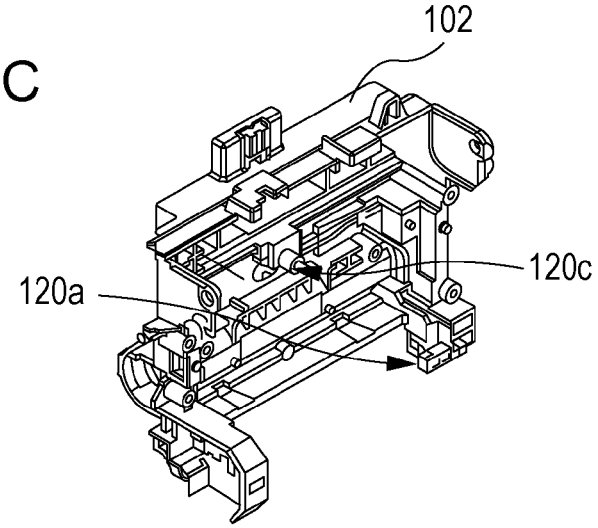
Figure 3D:
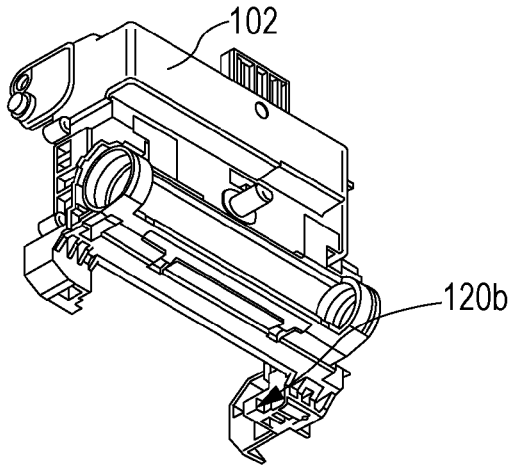
Figure 4A:
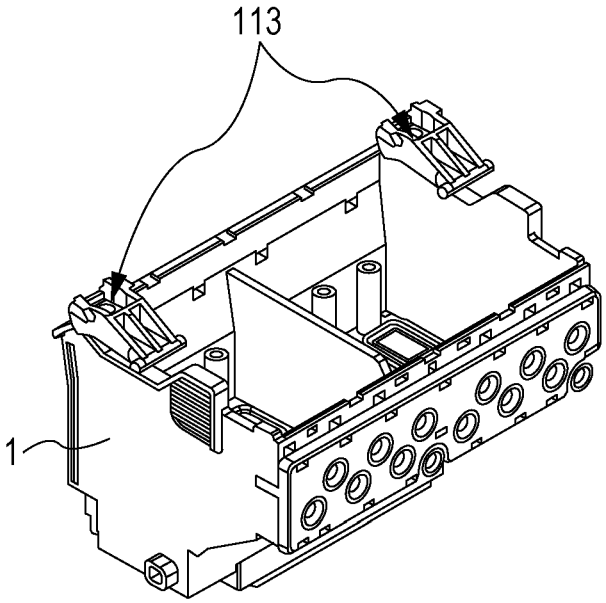
FIGS. 4A to 4D are perspective views of the ink jet recording head attached to the carriage, according to the embodiment of FIGS. 1A and 1B.
Figure 4B:
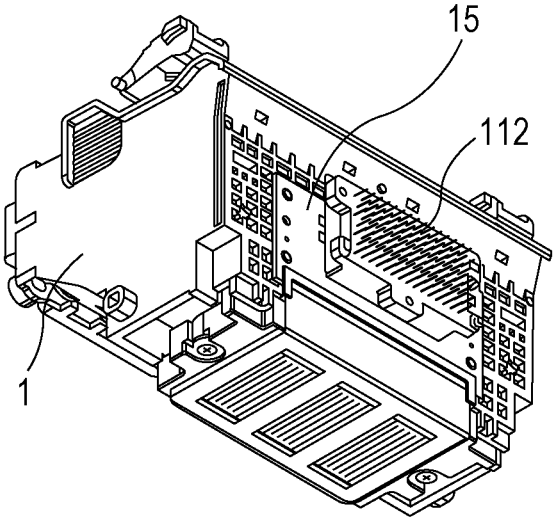
Figure 4C:
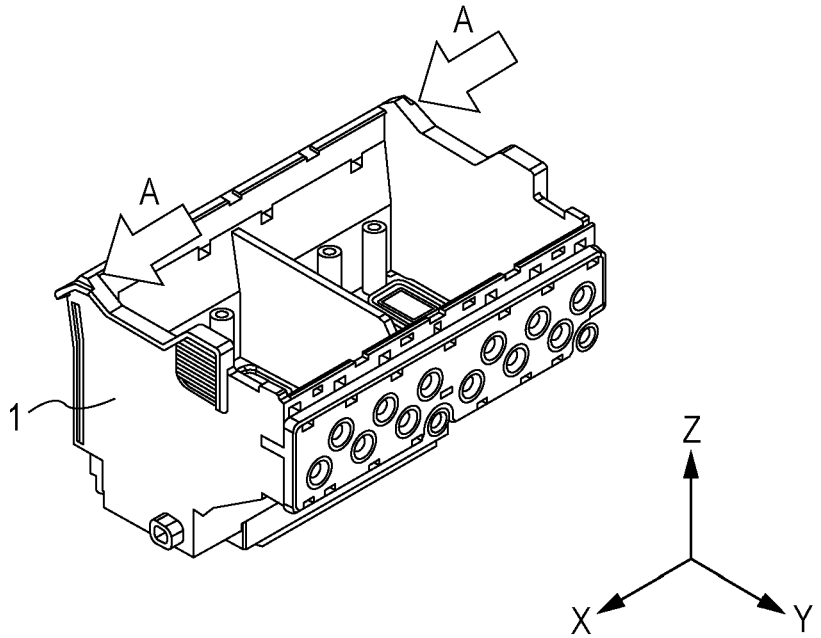
Figure 4D:
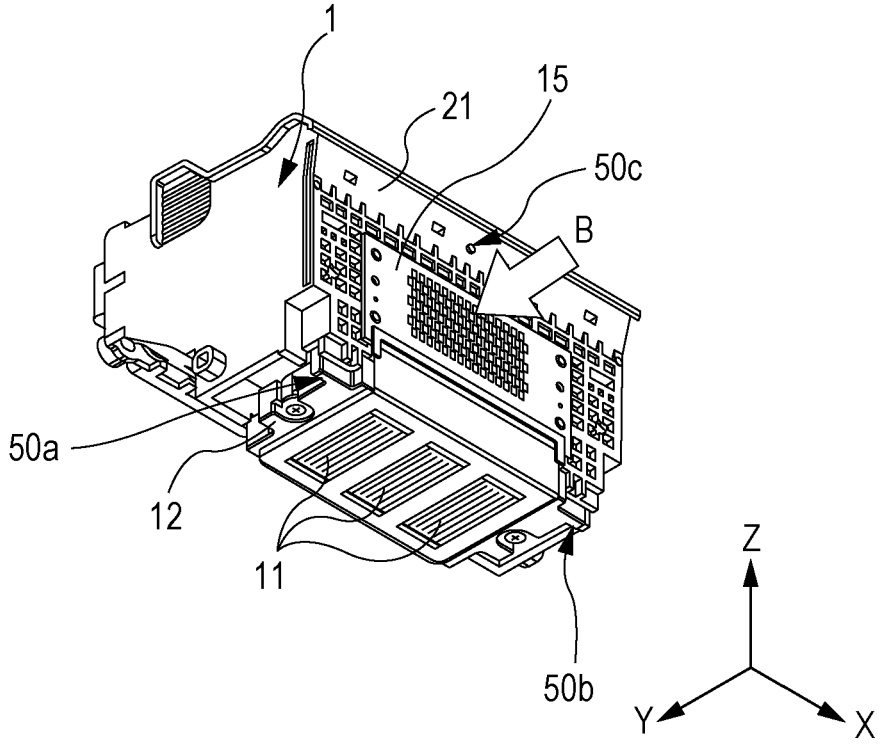

Next, the configuration for achieving the positioning of the ink jet recording head 1, which is the characteristic portion of the present invention, with respect to a carriage 102 (attaching portion) will be described. FIGS. 3A to 3D and 4A to 4D are perspective views of the ink jet recording head 1 (i.e., liquid ejection head) attached to the carriage 102 of the ink jet recording apparatus 100 (i.e., liquid ejection apparatus), according to this embodiment. FIG. 3A is a schematic perspective view of the ink jet recording apparatus 100 and FIG. 3B is a perspective view showing the carriage 102 and the ink jet recording head 1 attached thereto. FIGS. 3C and 3D are perspective views of the carriage 102, viewed from a side from which the ink jet recording head 1 is attached, and viewed from the back surface thereof, respectively. FIGS. 4A to 4D are diagrams showing a reaction force applied to the ink jet recording head 1 attached to the carriage 102. FIGS. 4A and 4C are perspective views of the ink jet recording head 1 including a surface to be connected to an ink supply tube 103 of the ink jet recording apparatus 100. FIGS. 4B and 4D are perspective views of the ink jet recording head 1 including the surface provided with the electric contact substrate 15. In FIGS. 3A to 3D and 4A to 4D, the direction X is the scanning direction of the carriage 102, the direction Y is the recording-medium conveying direction, and the direction Z is the ink-ejection direction. The X, Y and Z directions form a Cartesian coordinate system.

As shown in FIGS. 3A and 3B, the ink jet recording head 1 is attached to the carriage 102 that is scanned in the direction X along the guide shaft 101 of the ink jet recording apparatus 100. The ink jet recording apparatus 100 has the ink supply tube 103 for supplying ink to the ink jet recording head 1.

When the ink jet recording head 1 is attached to the carriage 102, the ink jet recording head 1 is subjected to the reaction force A in the direction −Y (i.e., the direction opposite the "Y" direction) and the direction −Z (i.e., the direction opposite the "Z" direction) shown in FIG. 4C from cams 113 (FIG. 4A) that follow the head set lever provided on the carriage 102. By receiving the reaction force A having a component in the direction Y, a positioning portion 50*c* (FIG. 4D) provided on the ink supply member 21 and serving as the second positioning portion on the ink jet recording head 1 is abutted to a positioning portion 120*c* (FIG. 3C) serving as the second positioning portion on the carriage 102. Furthermore, the ink jet recording head 1 is subjected to the reaction force B in the direction Y in FIG. 4D from electric connectors 112 (FIG. 4B) that electrically connect the ink jet recording head 1 to the ink jet recording apparatus 100. By receiving the reaction force B, positioning portions 50*a* and 50*b* (FIG. 4D) on the ink jet recording head 1, serving as the first positioning portions, are abutted to positioning portions 120*a* and 120*b* (FIGS. 3C and 3D) on the carriage 102, serving as the first positioning portions, respectively. The ink jet recording head 1 is thus positioned with respect to the carriage 102 in the direction Y, and then the ink jet recording head 1 is fixed to the carriage 102.

Herein, the positioning portions 50*a* and 50*b* provided on the support substrate 12 of the ink jet recording head 1 to achieve the positioning in the direction Y serve as reference surfaces used when the support substrate 12 and the recording element substrates 11 are bonded. As in this case, by making the positioning portions on the ink jet recording head 1 and carriage 102 serve as the reference surfaces when the support substrate 12 and the recording element substrates 11 are bonded, the recording element substrates 11 can be precisely positioned with respect to the carriage 102. Furthermore, because the support substrate 12 is made of alumina, it is rigid and less likely to be deformed by a reaction force applied thereto when attached to the carriage 102. Thus, more accurate positioning is possible.

Figure 5A:
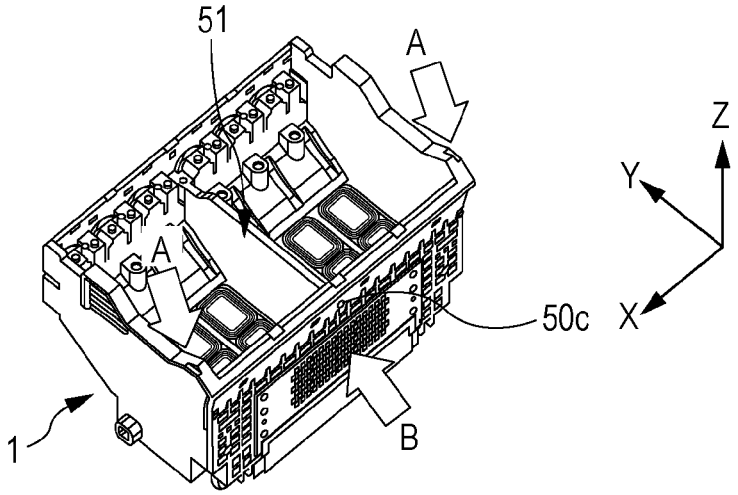
FIG. 5A is a perspective view.
Figure 5B:
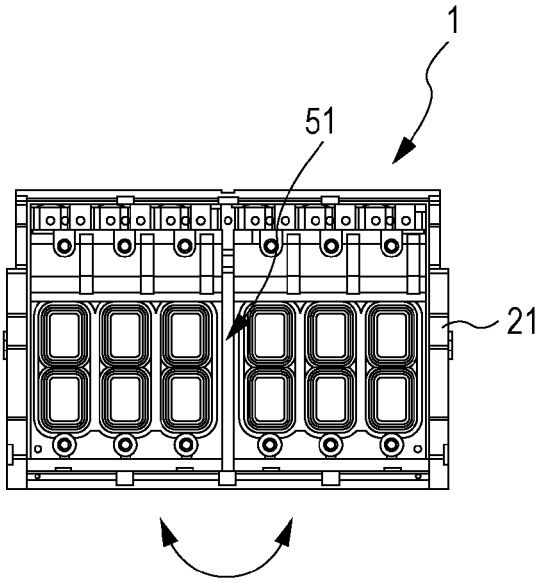
FIGS. 5B to 5E are plan views of the ink jet recording head according to the embodiment of FIGS. 1A and 1B.
Figure 5C:
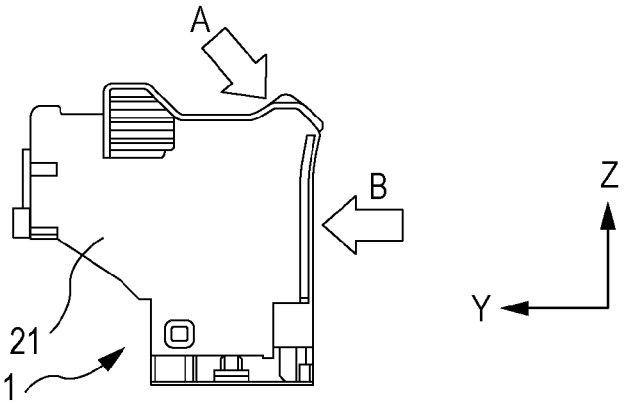
Figure 5D:
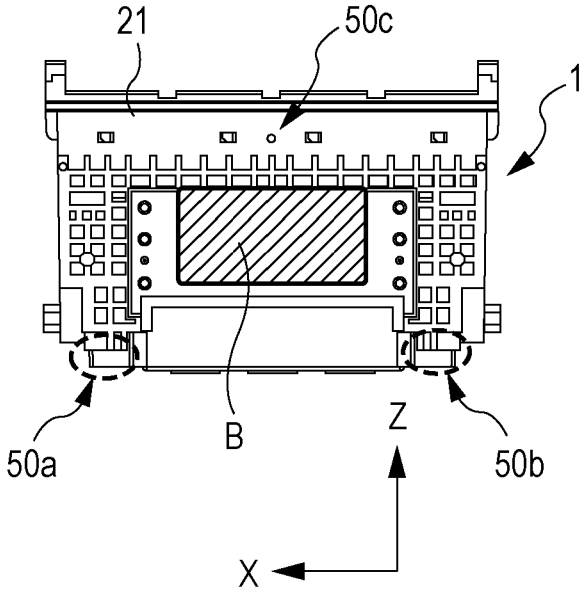

Next, referring to FIGS. 5A to 5E, a case where a slight positional deviation occurs when the support substrate 12 and the ink supply member 21 are connected to each other with the screws 30 will be described. FIG. 5A is a perspective view of the ink jet recording head 1, FIG. 5B is a top view of the same, FIG. 5C is a side view of the same, FIG. 5D is a back view of the same, showing a surface provided with the electric contact substrate 15, and FIG. 5E is a bottom view of the same.

Figure 5E:
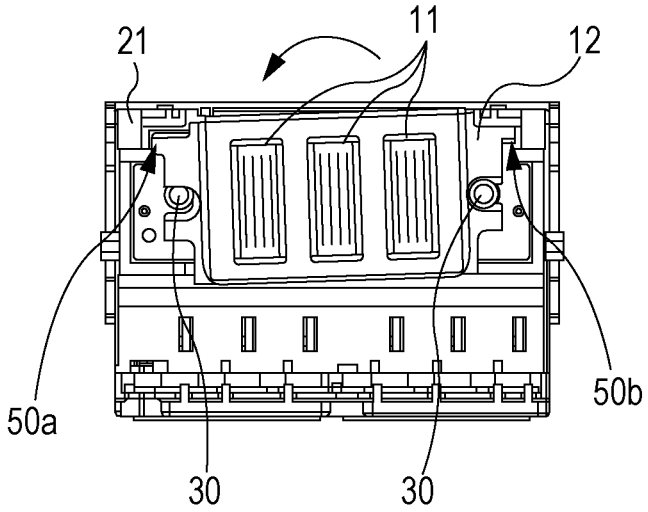
Figure 6A:
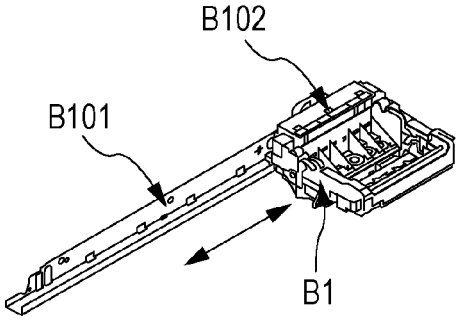
FIGS. 6A to 6H are diagrams of a conventional ink jet recording head and ink jet recording apparatus.
Figure 6B:
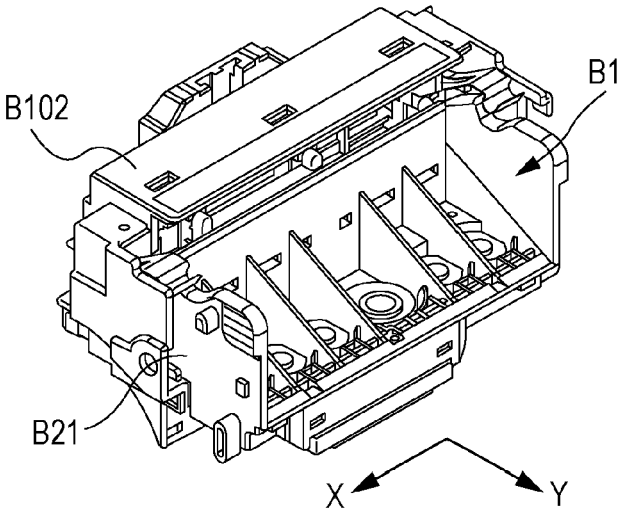
Figure 6C:
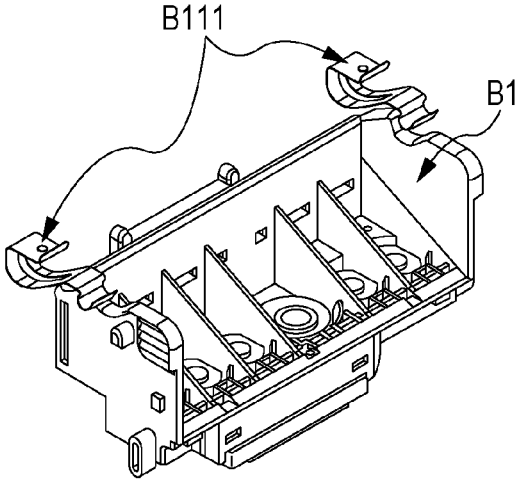
Figure 6D:
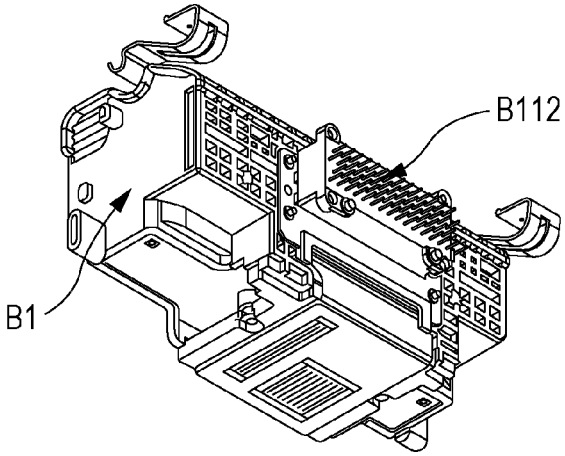
Figure 6E:
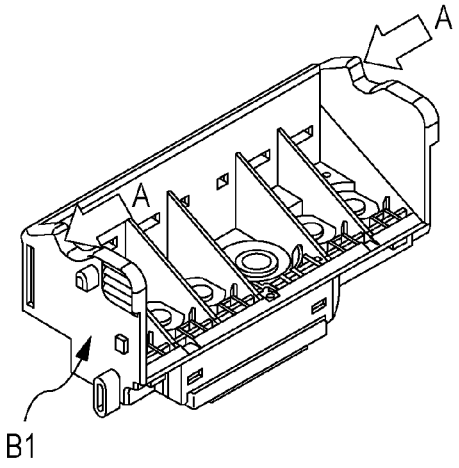
Figure 6F:
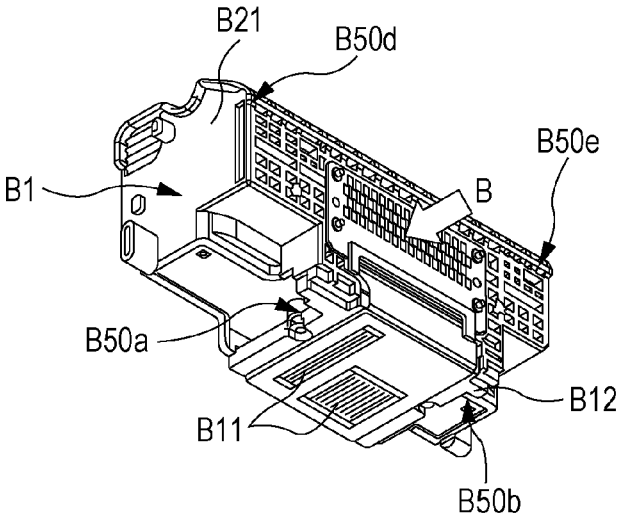
Figure 6G:
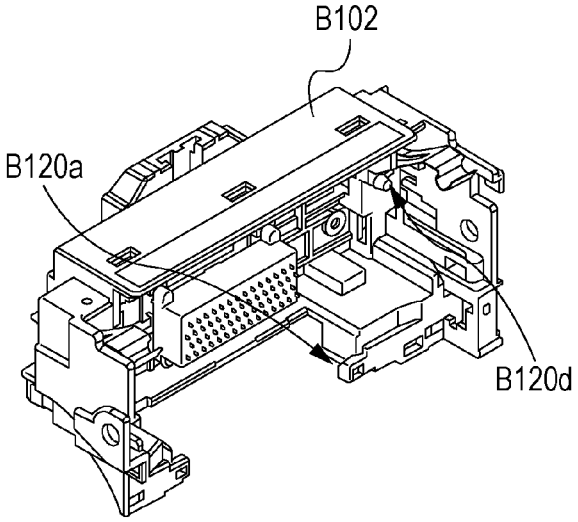
Figure 6H:
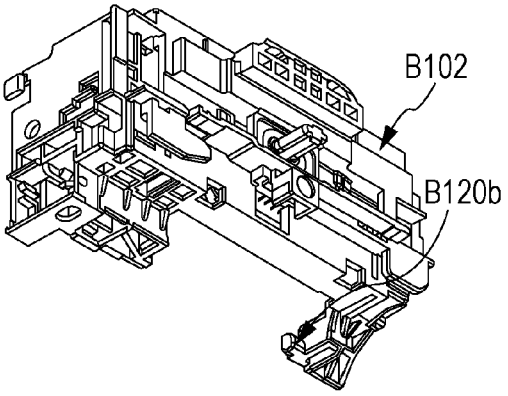
Figure 7A:
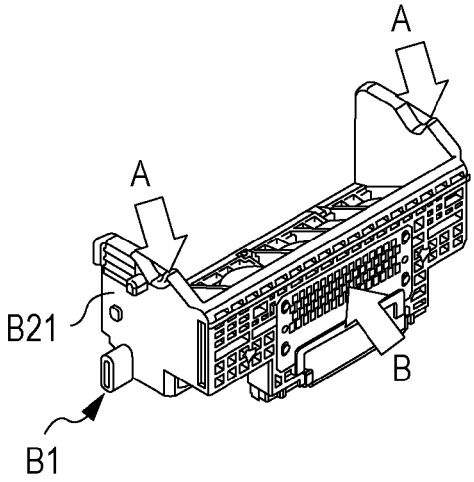
FIGS. 7A to 7E are diagrams of the conventional ink jet recording head.
Figure 7B:
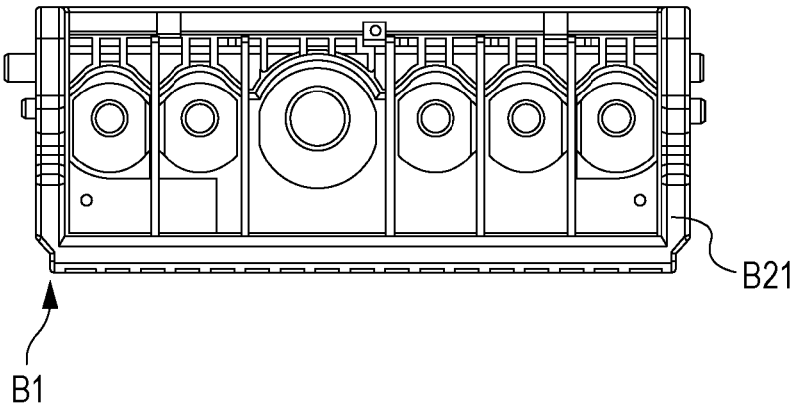
Figure 7C:
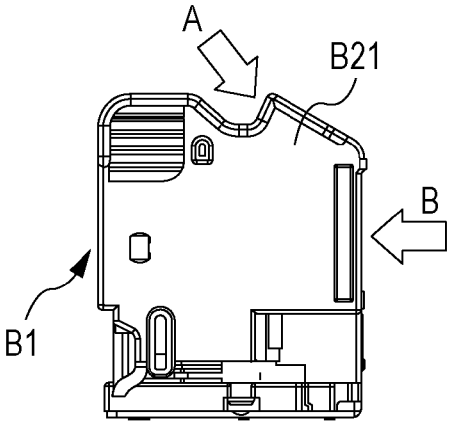
Figure 7D:
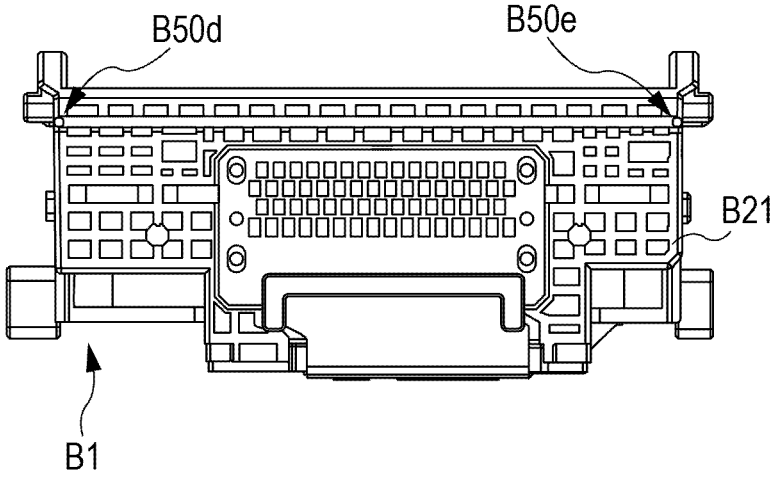
Figure 7E:
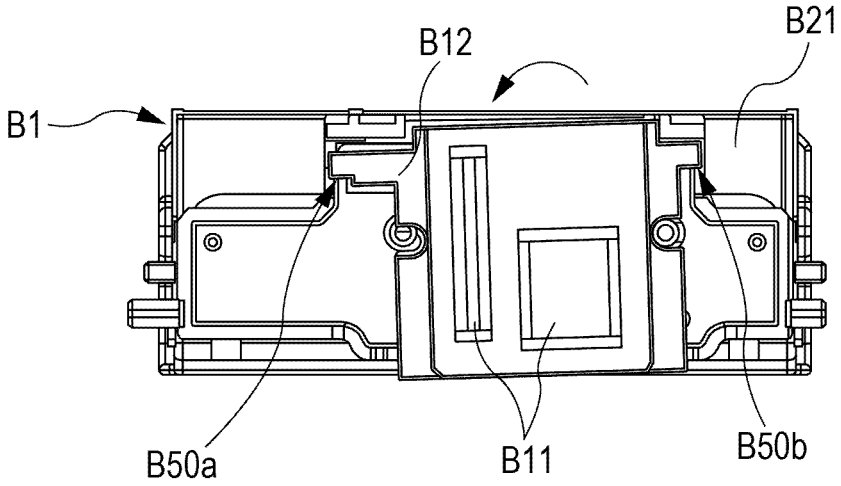

Let us assume that the support substrate 12 is fixed to the ink supply member 21 with an inclination in the direction indicated by the arrow, as shown in FIG. 5E. In this case, when the ink jet recording head 1 is attached to the carriage 102, the positioning portion 50*c* used for the positioning in the direction Y and provided on the ink supply member 21 is abutted to the positioning portion 120*c* on the carriage 102 (FIG. 3C) by the reaction force A. Furthermore, the positioning portion 50*a* used for the positioning in the direction Y and provided on the support substrate 12 is abutted to the positioning portion 120*a* on the carriage 102 (FIG. 3C) by the reaction force B.

Herein, the positioning portion 50*c* provided on the ink supply member 21 is provided between the positioning portions 50*a* and 50*b* provided on the support substrate 12 in the direction X. Therefore, the ink jet recording head 1 can be rotated by the reaction force B, in the direction indicated by the arrow in FIG. 5B, about a rotation shaft extending through the positioning portion 50*c* of the ink supply member 21 in the direction in which ink is ejected. Therefore, the ink jet recording head 1 can be rotated until the positioning portion 50*b* used for the positioning in the direction Y and provided on the support substrate 12 is abutted to the positioning portion 120*b* of the carriage 102. By this, the three positioning portions 50*a* to 50*c* on the ink jet recording head 1 are abutted to the positioning portions 120*a* to 120*c* on the carriage 102, whereby the recording element substrates 11 securely bonded to the support substrate 12 can be precisely attached to the carriage 102. Accordingly, the ink jet recording head 1 can be attached to the carriage 102 such that the direction in which the ejection ports 16 are arranged is perpendicular to the scanning direction of the carriage 102, and hence, a decrease in image quality can be suppressed.

Next, a problem arising when the ink supply member 21 is deformed due to the reaction force B will be described with reference to FIGS. 8A to 8C, which show Comparative Example. When the ink supply member 21 is deformed as indicated by bold lines in FIGS. 8A and 8B, the ink jet recording head 1 is obliquely attached to the guide shaft 101, as shown in FIG. 8C, which shows a side view of the ink jet recording head 1. That is, with the ink jet recording head 1 being attached to the carriage 102, the recording element substrates 11 may be inclined in the direction Y.

This decreases the distance accuracy of the ink jet recording head 1 and the recording medium, and the recording medium may touch the recording element substrates 11 of the ink jet recording head 1. In addition, a recording medium jam may occur in the ink jet recording apparatus 100. Furthermore, the distance between the ink jet recording head 1 and the recording medium is different between a recording-medium supply side and a recording-medium discharge side. Thus, the landing position of ink on the recording medium is different between the upstream side and the downstream side in the conveying direction (direction Y) of the recording medium, which may degrade the image quality.

To counter this, in this embodiment, the ink supply member 21 is provided with a deformation preventing rib 51, as shown in FIG. 5B. By providing the deformation preventing rib 51 on the back surface of the surface provided with the electric contact substrate 15, the possibility of the ink supply member 21 being deformed by the reaction force B, which is exerted by the electric connectors 112 provided on the carriage 102, can be reduced. Thus, it is possible to prevent the recording medium from touching the recording element substrates 11 and to prevent a decrease in image quality.

Figure 8A:
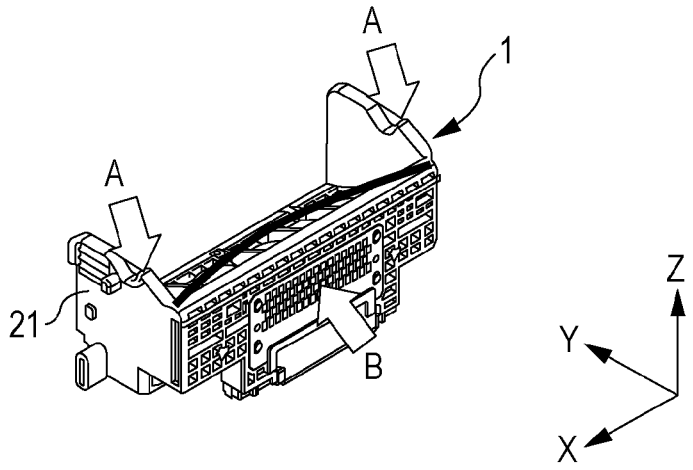
FIG. 8A is a perspective view.
Figure 8B:
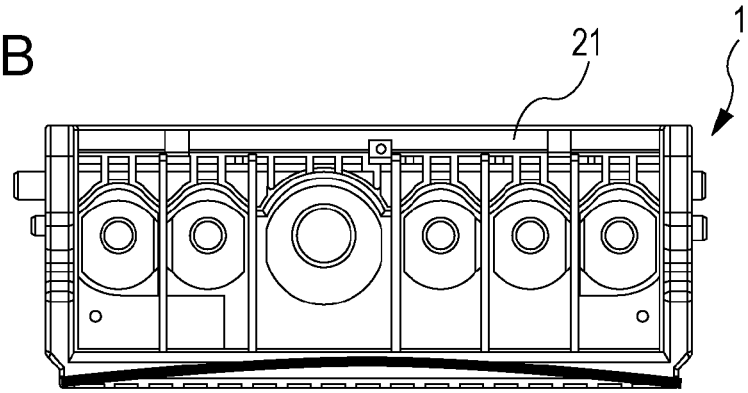
FIGS. 8B and 8C are plan views of an ink jet recording head according to Comparative Example.
Figure 8C:
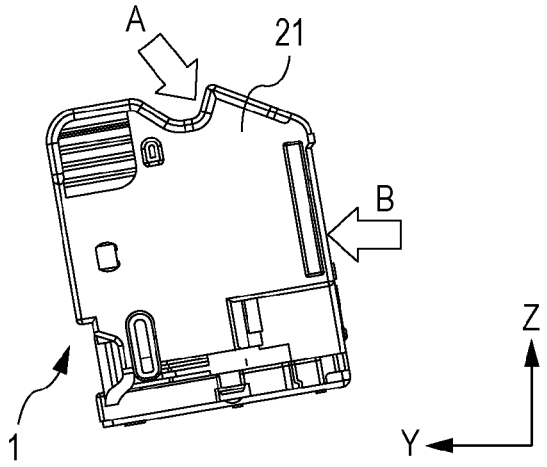

Furthermore, as shown in FIG. 8A, in the ink jet recording head 1 of Comparative Example, the outer wall of the ink supply member 21 is not provided at a portion facing the surface provided with the electric contact substrate 15. Thus, the ink supply member 21 may be deformed by the reaction force B exerted by the electric connectors 112. In contrast, in the ink jet recording head according to this embodiment 1, the outer wall of the ink supply member 21 is provided in a rectangular configuration as viewed from above. Thus, the possibility of the ink supply member 21 being deformed by the reaction force B, exerted by the electric connectors 112, can be further reduced.

Furthermore, as shown in FIG. 5A, by providing the deformation preventing rib 51 at a position facing the positioning portion 50*c* provided on the ink supply member 21, the possibility of the ink supply member 21 being deformed by the reaction force B exerted by the electric connectors 112 can be further reduced. An appropriate height of the deformation preventing rib 51 is up to the position of the positioning portion 50*c* provided on the ink supply member 21 in the direction Z.

Furthermore, as shown in FIG. 5D, the positioning portion 50*c* used for the positioning in the direction Y and provided on the ink supply member 21 is provided near the center of the back surface of the ink supply member 21 in the direction X. This makes it easier for the ink jet recording head 1 to be rotated by the reaction force B about the rotation shaft extending through the positioning portion 50*c* of the ink supply member 21 in the direction in which ink is ejected. Therefore, the positioning portions 50*a* to 50*c* used for the positioning in the direction Y and provided on the ink jet recording head 1 can be reliably abutted to the positioning portions 120*a* to 120*c* on the carriage 102. Accordingly, the accuracy of the positioning of the ink jet recording head 1 with respect to the carriage 102 in the direction Y can be further improved.

Furthermore, as shown in FIG. 5D, the center of the reaction force B in a contact area (a hatched area B) of the electric contact substrate 15 is located in an area defined by lines connecting the three positioning portions 50*a* to 50*c*, as viewed from the electric contact substrate 15 side. Thus, the reaction force B can be efficiently applied to the ink jet recording head 1, whereby the positioning portions 50*a* to 50*c* used for the positioning in the direction Y can be more reliably abutted to the positioning portions 120*a* to 120*c* on the carriage 102. Accordingly, the accuracy of the positioning of the ink jet recording head 1 with respect to the carriage 102 in the direction Y can be further improved.

Although the positioning in the direction Y has been described in this embodiment, the configuration of the positioning portion according to this embodiment may be applied to the positioning in a predetermined direction of the recording element substrates 11 in a plane established with a surface of the ejection ports 16 (See FIG. 2).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-191325 filed Aug. 27, 2010, which is hereby incorporated by reference herein in its entirety.

What is claimed is:

1. A liquid ejection head for ejecting liquid comprising:

a liquid ejection substrate having an ejection port surface in which ejection ports for ejecting liquid are provided;

a support substrate for supporting the liquid ejection substrate, the support substrate having two first positioning portions being in contact with an attaching portion, to which the liquid ejection head is attached, to determine the position of the liquid ejection head with respect to the attaching portion in a predetermined direction; and a housing for supporting the support substrate, the housing having a second positioning portion being in contact with the attaching portion to determine the position of the liquid ejection head with respect to the attaching portion in the predetermined direction, wherein a surface perpendicular to the ejection port surface and extending along the predetermined direction, the surface having the second positioning portion, is disposed between two surfaces perpendicular to the ejection port surface and extending along the predetermined direction, each surface of the two surfaces having one of the two first positioning portions, and wherein the liquid ejection head is rotatable about a rotation axis extending through the second positioning portion in a direction perpendicular to the ejection port surface to facilitate attachment of the two first positioning portions to the attaching portion.

2. The liquid ejection head according to claim 1, wherein the liquid ejection head is rotatable about a rotation axis extending through the second positioning portion in a direction perpendicular to the ejection port surface when attached to the attaching portion.

3. The liquid ejection head according to claim 1, wherein the liquid ejection substrate is provided on the support substrate using the two first positioning portions as reference.

4. The liquid ejection head according to claim 1, wherein the second positioning portion is provided near the center of the housing in a direction along the ejection port surface and perpendicular to the predetermined direction.

5. The liquid ejection head according to claim 1, wherein the housing has a rib that is provided on a back surface of a surface having the second positioning portion and extends in the predetermined direction.

6. The liquid ejection head according to claim 5, wherein the rib is provided at a position corresponding to the second positioning portion.

7. The liquid ejection head according to claim 5, wherein an outer wall of the housing is provided in a rectangular configuration as viewed in a direction perpendicular to the ejection port surface, and wherein the rib extends from the back surface to the outer wall facing the back surface.

8. The liquid ejection head according to claim 1, wherein the housing has an electric wiring substrate that is provided on a surface having the second positioning portion and electrically connects the liquid ejection head to the attaching portion when the liquid ejection head is attached to the attaching portion, the electric wiring substrate being disposed such that the center thereof is located between the two surfaces each having one of the two first positioning portions.

9. A liquid ejection apparatus for ejecting liquid, comprising:

a liquid ejection head that includes a liquid ejection substrate having an ejection port surface in which ejection ports for ejecting liquid are provided, a support substrate for supporting the liquid ejection substrate, and a housing for supporting the support substrate;

an attaching portion to which the liquid ejection head is attached;

two pairs of first positioning portions including two first positioning portions provided on the support substrate and two first positioning portions provided on the attaching portion, the two first positioning portions provided on the support substrate and the two first positioning portions provided on the attaching portion being in contact with each other to determine the position of the liquid ejection head with respect to the attaching portion in a predetermined direction; and a pair of second positioning portions including one second positioning portion provided on the housing and one second positioning portion provided on the attaching portion, the second positioning portion provided on the housing and the second positioning portion provided on the attaching portion being in contact with each other to determine the position of the liquid ejection head with respect to the attaching portion in the predetermined direction, wherein a surface perpendicular to the ejection port surface and extending along the predetermined direction, the surface having the pair of second positioning portions, is disposed between two surfaces perpendicular to the ejection port surface and extending along the predetermined direction, each surface of the two surfaces having one of the two pairs of the first positioning portions, and wherein the liquid ejection head is rotatable about a rotation axis extending through the second positioning portion in a direction perpendicular to the ejection port surface to facilitate attachment of the two first positioning portions to the attaching portion.

* * * * *